US009657558B2

(12) United States Patent
Fu et al.

(10) Patent No.: US 9,657,558 B2
(45) Date of Patent: May 23, 2017

(54) METHOD FOR TREATING AND MEASURING SUBTERRANEAN FORMATIONS

(71) Applicant: Schlumberger Technology Corporation, Sugar Land, TX (US)

(72) Inventors: Diankui Fu, Novosibirsk (RU); Alejandro Pena, Katy, TX (US); Peiwen Xia, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 207 days.

(21) Appl. No.: 13/729,557

(22) Filed: Dec. 28, 2012

(65) Prior Publication Data

US 2014/0184228 A1 Jul. 3, 2014

(51) Int. Cl.

| | |
|---|---|
| ***E21B 43/26*** | (2006.01) |
| ***E21B 43/267*** | (2006.01) |
| ***E21B 49/00*** | (2006.01) |

(52) U.S. Cl.

CPC ..... *E21B 43/26* (2013.01); *E21B 43/267* (2013.01); *E21B 49/006* (2013.01)

(58) Field of Classification Search

CPC ..... E21B 43/26; E21B 43/267; E21B 49/006
USPC ..... 324/339
See application file for complete search history.

(56) References Cited

U.S. PATENT DOCUMENTS

| | | | | |
|---|---|---|---|---|
| 5,782,300 | A | 7/1998 | James et al. | |
| 6,006,831 | A | 12/1999 | Schlemmer et al. | |
| 6,021,822 | A | 2/2000 | Izawa et al. | |
| 6,725,931 | B2 | 4/2004 | Nguyen et al. | |
| 6,776,235 | B1 | 8/2004 | England | |
| 6,787,505 | B1 | 9/2004 | Maitland et al. | |
| 7,392,847 | B2 | 7/2008 | Gatlin et al. | |
| 7,581,590 | B2 | 9/2009 | Lesko et al. | |
| 7,718,583 | B2 | 5/2010 | Barmatov et al. | |
| 7,824,769 | B2 | 11/2010 | Nakatsuka et al. | |
| 8,061,424 | B2 | 11/2011 | Willberg et al. | |
| 2006/0102345 | A1 | 5/2006 | McCarthy et al. | |
| 2008/0125335 | A1* | 5/2008 | Bhavsar | 507/219 |
| 2009/0015253 | A1* | 1/2009 | Forgang et al. | 324/303 |
| 2009/0314488 | A1 | 12/2009 | Droger | |
| 2010/0212902 | A1 | 8/2010 | Williams et al. | |

(Continued)

OTHER PUBLICATIONS

Schoch, K.F., Update on electrically conductive polymers and their applications, IEEE Electrical Insulation Magazine, May/Jun. 1994, vol. 10, No. 3, p. 29-32.*

(Continued)

*Primary Examiner* — Thomas F Valone
(74) *Attorney, Agent, or Firm* — Michael L. Flynn; Jody Lynn DeStefanis; Robin Nava

(57) ABSTRACT

A method of treating a subterranean formation penetrated by a wellbore comprising injecting electrically conductive or electromagnetic fibers into the subterranean formation during hydraulic fracturing is provided. Suitable metallic materials, organic polymers, and organic polymers coated with or containing conductive or electromagnetic materials are described. The treatment is followed by measurement of resistivity and/or electromagnetic properties, optionally by a crosswell technique.

14 Claims, 1 Drawing Sheet

Logarithmic conductivity ladder locating some metals and conducting polymers

(56) References Cited

U.S. PATENT DOCUMENTS

2012/0205577 A1 8/2012 Reddy et al.

OTHER PUBLICATIONS

PetroWiki, Borehole Instability, SPE International, p. 1-5, http://petrowiki.org;borehole_instability, Nov. 5, 2015.*

J. Xie, et al. "Conductive Core—Sheath Nanofibers and Their Potential Application in Neural Tissue Engineering," Advanced Functional Materials, vol. 19, Issue 14, pp. 2312-2318, Jul. 24, 2009.

X. Jin, et al, "Electrospun Nanocomposite Polyacrylonitrile Fibers Containing Carbon Nanotubes and Cobalt Ferrite," Polymer Composites, vol. 33, issue 3, pp. 317-323, Mar. 2012.

E. Munoz, et al, "Highly Conducting Carbon Nanotube/Polyethyleneimine Composite Fibers," Advanced Materials, 2005, vol. 17, issue No. 8, p. 1064.

* cited by examiner

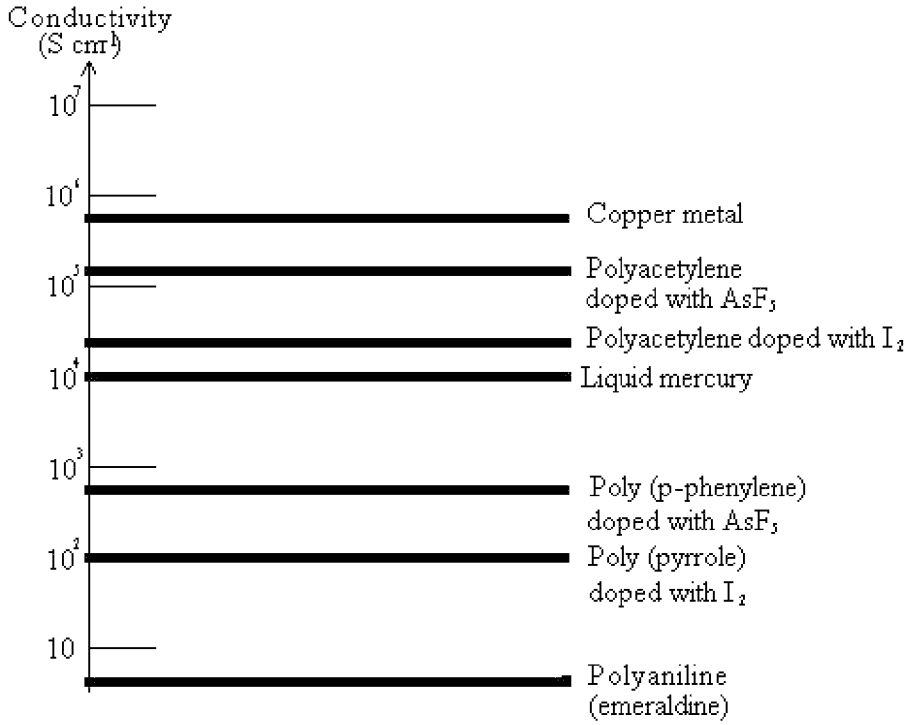
Logarithmic conductivity ladder locating some metals and conducting polymers

METHOD FOR TREATING AND MEASURING SUBTERRANEAN FORMATIONS

BACKGROUND

Hydraulic fracturing treatment is one of the most effective methods of improving hydrocarbon production. Hydraulic fracturing is particularly useful in reservoirs with low permeabilities. Oil or gas production from shale, for example, is frequently not economically feasible without hydraulic fracturing treatments being performed.

During hydraulic fracturing treatments, propping agents, or proppants, such as sands or ceramic materials are injected into the formation together with fluids, typically high viscosity fluids, at pressures sufficient to create fractures in the formation rock. The proppants are used to hold the fractures open. The productivity of the well is determined, inter alia, by the geometry and permeability of the propped fracture.

During hydraulic fracturing treatments, control of fracture height growth can be an important issue. In situations where the water table is close to the fracture zones, or where the fracture zones have low stress barriers, where fracture height growth can result in screenouts, control of the fracture height may be critical. One common technique for the control of fracture height is to use fluids with lower viscosity, such as viscoelastic surfactants. Lower viscosity fluids, however, do not transport large-sized proppants effectively in the fracture. One method of addressing that issue has been the incorporation of fiber into the surfactant fluids.

Fiber based technologies are known which allow the controlled placement of proppants inside the fracture to allow optimized propped geometry and/or fracture permeability. Fibers are also used in other well treatment fluids.

SUMMARY

The disclosed subject matter of the application provides a method of treating a subterranean formation penetrated by a wellbore by injecting a fiber composition comprising electrically conductive fibers, electromagnetic fibers, or a combination thereof into the subterranean formation during hydraulic fracturing or other treatments. The disclosed subject matter of the application further provides a method of measuring the resistivity and/or electromagnetic property of the formation after the treatment to determine the location of the fibers that were in the treatment fluid.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the method for treating and measuring the location of the treatment fluid in a subterranean formation are described with reference to the following FIGURE.

FIG. 1 illustrates the relative conductivity of several materials, including several conductive polymers which may be used in embodiments of the method.

DETAILED DESCRIPTION

Embodiments may be described in terms of treatment of vertical wells, but are equally applicable to wells of any orientation. Embodiments may be described for hydrocarbon production wells, but it is to be understood that embodiments may be used for wells for production of other fluids, such as water or carbon dioxide, or, for example, for injection or storage wells. It should also be understood that throughout this specification, when a concentration or amount range is described as being useful, or suitable, or the like, it is intended that any and every concentration or amount within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 10" is to be read as indicating each and every possible number along the continuum between about 1 and about 10. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range. It should also be understood that fracture closure includes partial fracture closure.

As used herein, the term hydraulic fracturing treatment means the process of pumping fluid into a closed wellbore with powerful hydraulic pumps to create enough downhole pressure to crack or fracture the formation. This allows injection of proppant-laden fluid into the formation, thereby creating a plane of high-permeability sand through which fluids can flow. The proppant remains in place once the hydraulic pressure is removed and therefore props open the fracture and enhances flow into the wellbore.

As used herein, the term induction relates to a wireline log of formation resistivity based on the principle of inducing alternating current loops in the formation and measuring the resultant signal in a receiver. In the simplest device, a transmitter antenna transmits a continuous sinusoidal signal of medium frequency (for example, 5 Hz to 1 kHz). The exact frequency is chosen by modeling and simulation of the borehole environment, well separation, and formation resistivity. The magnetic moment produced by the transmitter is, for example, 100,000 times stronger than the source in a conventional single-well induction logging system.

The transmitter signal induces electrical currents to flow in the formation between the wells. The currents, in turn, induce a secondary magnetic field related to the electrical resistivity of the rock. At the receiver borehole, typically an array of four coil receivers detects the primary magnetic field generated by the transmitter as well as the secondary magnetic field from the induced currents.

For each receiver station, the transmitter in the other well traverses the interval of interest at a logging speed of, for example, 2,000 to 5,000 ft/h [600 to 1,520 m/h]. This signal is proportional to the conductivity of the formation, with contributions from different regions of the formation summing approximately in conductivity. As a result, the induction log is most accurate at high conductivities and with resistive invasion. Once a complete transmitter traverse, or profile, is collected for a receiver position, the receiver tool is repositioned, and the process is repeated.

The term fiber as used herein includes, without limitation, continuous filaments and staple fibers. The fiber may be a constituent of a multifilament yarn, a knitted or woven fabric or a bonded or unbonded non-woven fibrous web or assembly. The fibers may be organic or inorganic and natural or synthetic.

A first embodiment of the disclosed subject matter of the application provides a method of treating a subterranean formation penetrated by a wellbore comprising: injecting electrically conductive or electromagnetic fibers into the subterranean formation during hydraulic fracturing treatment.

Fibers useful in embodiments of the method may be electrically conductive or possess electromagnetic properties impacting the conductivity of the fracture, in which the fibers reside. Such impact on the conductivity of the fracture allows the use of induction logging to gain information on the size of the fracture.

In one embodiment of the method, such fibers may be selected from the group consisting of carbon fibers, metal fibers, fibers made from conductive polymers, polymeric fibers containing a conductive material, metal coated fibers, and mixtures thereof. Polymeric fibers containing a conductive material include thermoplastic fibers coated with a conductive material or thermoplastic fibers impregnated or blended with a conductive material. For instance, in one embodiment, thermoplastic fibers may be used that are coated with silver, copper, iron, nickel, cobalt or combinations thereof.

Carbon fibers which may be used in embodiments further include graphite or graphite fiber. Graphite or graphite fiber contain mainly carbon atoms (preferably at least about 90% carbon) bonded together in elongated microscopic crystals.

In an alternative embodiment, the disclosed subject matter of the application provides a method in accordance with any of the preceding embodiments, except that nylon fibers coated with electrically conductive carbon particles, for example those available from Resistat Fiber Collection (Enka, N.C., U.S.A.) are used.

In an alternative embodiment, the disclosed subject matter of the application provides a method in accordance with any of the preceding embodiments, except that conductive fibers, on which carbon is carried in a nylon core surrounded by a polyester sheath, for example those available from Kuraray America Inc. (New York, N.Y., U.S.A.) under the commercial name of CLACARBO™, are used. In an alternative embodiment, the disclosed subject matter of the application provides a method in accordance with any of the preceding embodiments, except that carbon fibers available, for example, under the trade name TORAYCA™, available from Toray Carbon Fibers America, Inc (Flower Mound, Tex., U.S.A.) are used.

Metal fibers useful in embodiments of the method include, for example, silver, copper, gold, aluminum, zinc, nickel, brass, bronze, iron, platinum, carbonized steel, lead, stainless steel, and any combination of two or more thereof. Table 1 illustrates the relative conductivity of such metals with the top of the list being the most conductive.

TABLE 1

| Conductive Order of Metals of Equally Sized Samples | |
|---|---|
| 1 | Pure Silver |
| 2 | Pure Copper |
| 3 | Pure Gold |
| 4 | Aluminum |
| 5 | Zinc |
| 6 | Nickel |
| 7 | Brass |
| 8 | Bronze |

TABLE 1-continued

| Conductive Order of Metals of Equally Sized Samples | |
|---|---|
| 9 | Pure Iron |
| 10 | Platinum |
| 11 | Carbonized Steel |
| 12 | Pure Lead |
| 13 | Stainless Steel |

In an alternative embodiment, the disclosed subject matter of the application provides a method in accordance with any of the preceding embodiments, except that the fibers include fibers made from conductive polymers. In an alternative embodiment, the disclosed subject matter of the application provides a method in accordance with any of the preceding embodiments, except that the fibers are conductive polymers selected from the group consisting of doped conjugated polymers. In an alternative embodiment, the disclosed subject matter of the application provides a method in accordance with any of the preceding embodiments, except that the fibers are selected from the group consisting of polyacetylene, poly(p-phenylene), poly(pyrrole), and polyaniline.

One process of making conductive polymeric fibers which may be used in some embodiments of the method involves electrospinning fibers from a blend of polymers dissolved in an organic solvent. Conductive polymeric fibers may be used in embodiments of the method irrespective of the method by which the conductive polymeric fibers are made.

Any type of fiber which may carry conductive or electromagnetic materials, such as carbon coated ceramic fibers, may also be used in certain embodiments of the method. One example of such fiber includes the fiber available under the trade name 4DG™ from Fiber Innovation Technology, Inc. (Johnson City, Tenn., U.S.A.). A deep groove in the 4DG fiber allows the trapping of fine conductive or electromagnetic materials.

In an alternative embodiment, the disclosed subject matter of the application provides a method in accordance with any of the preceding embodiments, except that the fibers comprise a blend of conductive polymers and non-conductive polymers.

In an alternative embodiment, the disclosed subject matter of the application provides a method in accordance with any of the preceding embodiments, except that the conductive fibers are polymeric fibers selected from the group consisting of polymeric fibers at least partially coated with a conductive material, polymeric fibers at least partially coated with an electromagnetic material; at least partially hollow polymeric fibers which are at least partially filled with a conductive material; at least partially hollow polymeric fibers which are at least partially filled with an electromagnetic material; and a combination of two or more of the foregoing. U.S. Pat. No. 6,021,822 discloses hollow fibers made from rayon, acetate, polyester, or polyamide, and which may optionally contain stabilizer, anti-oxidant, flame-retardant, anti-static agent, whiteness enhancer, catalyst, anti-coloring agent, heat resistant agent, coloring agent, inorganic particles, or combinations thereof.

In another alternative embodiment, the disclosed subject matter of the application includes methods of making electromagnetic or resistivity measurements of a fracture in a subterranean formation including injecting a fiber composition which comprises non-metal fibers, metal fibers, or combinations thereof.

FIG. 1 illustrates the relative conductivity of certain doped polymers (polymers doped with $I_2$ or $AsF_3$), several metals, and a polymer.

In an alternative embodiment, the disclosed subject matter of the application provides a method in accordance with any of the preceding embodiments, except that the conductive or electromagnetic fibers are single strand fibers. In alternative embodiments, the conductive or electromagnetic fibers are sheath/core fibers.

In an alternative embodiment, the disclosed subject matter of the application provides a method in accordance with any of the preceding embodiments, except that the fibers are sheath core fibers comprising a carbon-covered core and a protective sheath. For example, U.S. Pat. No. 7,824,769 describes carbon black containing first thermoplastic polymers, which act as a sheath, surrounding a second thermoplastic polymer, which acts as core. As another example of core/sheath materials, Advanced Functional Materials, Volume 19, Issue 14, pages 2312-2318, Jul. 24, 2009 also describes a polypyrrole/polylactic acid sheath or core with polypyrrole/poly(ϵ-caprolactone) sheath or core fibers. An alternative embodiment utilizes electrically conductive fibers having electrically-conductive particles embedded into an annular region located at the periphery of a sheath component of a drawn melt-spun sheath/core bicomponent fiber.

An alternative embodiment provides a method in accordance with any of the preceding embodiments, except that conductive carbon nanotube-containing fibers are used. Methods for producing such fibers are known and such fibers may be used irrespective of the manner of producing the fibers. For example, Polymer Composites, volume 33, issue 3, pages 317-323, March 2012 describes nanocomposite fibers made from polyacrylonitrile (PAN) containing carbon nanotubes (CNTs) and cobalt ferrite ($CoFe_2O_4$). As an alternative example, Advanced Materials, 2005, volume 17, issue no. 8, page 1064, describes single walled carbon nanotube and polyethyleneimine fibers.

In an alternative embodiment, the disclosed subject matter of the application provides a method in accordance with any of the preceding embodiments, except that one or more classes of fibers may be used in combination. For example, metal fibers and carbon fibers may be used in combination. Alternatively, metal fibers and conductive polymer fibers may be used in combination. Alternatively, carbon fibers and conductive polymer fibers may be used in combination. Alternatively, a combination of conductive polymer fibers, metal fibers and carbon fibers may be used.

Fibers useful in embodiments of the method may be blended with the treatment fluid, for example fracturing fluid used in the hydraulic fracturing treatment. Alternatively, the fibers may be separately added during the treatment, for example hydraulic fracturing, by suspension in a carrier fluid. In some embodiments, the fibers, and optionally one or more proppants, may be suspended in a carrier fluid and added into the fracture created by a separate fracturing fluid. In an alternative embodiment, the disclosed subject matter of the application provides a method in accordance with any of the preceding embodiments, except that the fibers, and optionally one or more proppants, are added to the fracturing fluid.

In an alternative embodiment, the disclosed subject matter of the application provides a method in accordance with any of the preceding embodiments, except that the conductive or electromagnetic fibers constitute from more than 0 to 100 percent by weight of the proppant plus fibers. All individual values and subranges from 0 to 100 percent by weight are included herein and disclosed herein; for example, the fiber may constitute a percentage of the proppant plus fibers from a lower limit of 0, 10, 20, 30, 40, 50, 60, 70 80 or 90 weight percent to an upper limit of 5, 15, 25, 35, 45, 55, 65, 75, 85, 95 or 100 weight percent. For example, the weight percentage of proppant plus fibers that are fibers may be in the range of from more than 0 to 100 weight percent, or in the alternative, from 20 to 80 weight percent, or in the alternative, from 20 to 80 weight percent, or in the alternative, from 20 to 50 weight percent, or in the alternative, from 60 to 90 weight percent.

In an alternative embodiment, the disclosed subject matter of the application provides a method in accordance with any of the preceding embodiments, except that the fibers are present, for example in a fracturing fluid, at concentrations from 1 to 150 lb/thousand U.S. gallons (Mgal) fracturing fluid. All individual values and subranges from 0.12 to 18 $kg/m^3$ (1 to 150 lb/Mgal;) are included herein and disclosed herein; for example, the amount of fibers in the fracturing fluid can be from a lower limit of 0.12, 1.2, 2.4, 4.8, 7.2, 9.6, 12, 14.4 or 16.8 $kg/m^3$ (1, 10, 20, 40, 60, 80, 100, 120, or 140 lb/Mgal) to an upper limit of 1.2, 3.6, 7.2, 12 or 14.4 $kg/m^3$ (10, 30, 60, 100, or 120 lb/Mgal;). For example, the amount of fibers in the fracturing fluid may be in the range of from 0.12 to 18 $kg/m^3$ (1 to 150 lb/Mgal), or in the alternative, in the range of from 1.2 to 12 $kg/m^3$ (10 to 100 lb/Mgal), or in the alternative, in the range of from 2.4 to 7.2 $kg/m^3$ (20 to 60 lb/Mgal).

In an alternative embodiment, the disclosed subject matter of the application provides a method in accordance with any of the preceding embodiments, except that the fibers have a length of from 1 mm to 30 mm. In an alternative embodiment, the disclosed subject matter of the application provides a method in accordance with any of the preceding embodiments, except that the fibers have a diameter of from 1 micron to 200 microns. In one embodiment, the fibers used can be longer than 2 mm and up to 20 mm with a diameter of 10-200 microns. In another embodiment, the ratio between any two of the three dimensions of the fibers may be greater than 5 to 1.

An alternative embodiment utilizes a metal fiber with a length longer than 2 mm and up to 20 mm and a diameter of 10 to 200 microns.

Any treatment fluid may be used in embodiments of the method, including, for example, cellulose derivatives, such as hydroxyethylcellulose (HEC), hydroxypropylcellulose (HPC), carboxymethylhydroxyethylcellulose (CMHEC) and carboxymethycellulose (CMC), with or without cross-linkers, guar-based fluids, such as guar derivatives hydroxypropyl guar (HPG), carboxymethyl guar (CMG), and carboxymethylhydroxypropyl guar (CMHPG) and viscoelastic surfactants (VES). Other treatment fluids which may be used in some embodiments of the method include acid fracturing fluids, such as hydrochloric acid based fluids, foamed fluids and energized fluids. In embodiments, fibers may be added to fracture fluids for improved proppant transport and/or for proppant flowback control. Other treatment fluids to which fibers may be added include lost circulation fluids, and cements.

In an alternative embodiment, the disclosed subject matter of the application provides a method in accordance with any of the preceding embodiments, except that the method further comprises measuring resistivity and/or electromagnetic measurements of hydraulic fractures created by injecting a fracturing fluid into the subterranean formation. Such measuring may be made in accordance with one known commercial method available from Schlumberger. Ltd.

under the trade name DEEPLOCK-EM™, which is similar to conventional induction logging but utilizes crosswell electromagnetic imaging which expands the scale of resistivity logging from the near-wellbore environment to reservoir monitoring, directly measuring formation resistivity in wells up to 1,000 m apart.

The electrically conductive or electromagnetic fibers used in embodiments may be used in a recent approach to improving hydraulic fractures, such as the methods disclosed in U.S. Pat. Nos. 6,776,235; 7,581,590; and 8,061,424, the disclosures of which are incorporated herein by reference. In such methods, proppant clusters, as opposed to a continuous proppant pack, are placed in a fractured subterranean formation so as to produce flow channels through which formation fluids may flow. Such proppant placement may be referred to heterogeneous proppant placement.

One embodiment provides a method for fracturing a subterranean formation comprising sequentially injecting into a wellbore, alternate stages of proppant-containing fracturing fluids having a contrast in their ability to transport propping agents to improve proppant placement; wherein the proppant comprises electrically conductive or electromagnetic fibers; and measuring resistivity of hydraulic fractures created by injecting the proppant-containing fracturing fluid by crosswell electromagnetic imaging.

Another embodiment provides a method for hydraulic fracturing of subterranean formation comprising: injecting into a borehole a fracturing fluid containing thickeners to create a fracture in the formation; and periodic introduction of proppant into the fracturing fluid to supply the proppant into the created fracture thereby forming proppant clusters within the fracture that prevent fracture closure and providing channels for flowing formation fluids between the clusters, wherein the periodic introduction of proppant comprises introducing either a reinforcing or consolidation material or both, thus increasing the strength of the proppant clusters formed into the fracture fluid, whereby volume of injection of proppant-containing fracturing fluid is less than the volume of injection of fluid containing no proppant to create smaller proppant clusters and larger channels between them for formation fluids to pass and wherein the reinforcing or consolidating material or both comprise electrically conductive, electromagnetic fibers, or a combination thereof; and measuring resistivity of the fracture created by crosswell electromagnetic imaging.

Yet another embodiment provides a method for fracturing a subterranean formation comprising: injecting well treatment fluid comprising proppant and channelant through a wellbore into a fracture in a subterranean formation, wherein the channelant comprises a solid acid-precursor to generate acid in the fracture; placing the proppant in the fracture in a plurality of proppant clusters forming pillars spaced apart by the channelant; and, removing the channelant to form open channels around the pillars for fluid flow from the formation through the fracture toward the wellbore; wherein the treatment fluid comprises alternating volumes of proppant-rich fluid separated by volumes containing the channelant, wherein the channelant comprises electrically conductive, electromagnetic fibers, or a combination thereof; and measuring resistivity of the fracture created by crosswell electromagnetic imaging.

In yet another embodiment, a method is provided wherein the electrically conductive or electromagnetic fibers are blended with a particulate material and further wherein the particulate material is a polymer material which increases in hardness under down-hole conditions thereby providing proppant flowback control. Proppant flowback control relates to the practice of applying a surface treatment to some of the proppant so that the particles of proppant in the pack adhere to one another. This is done in order to minimize the return of proppant particles, especially fines, as liquid flows out of the fracture. For example U.S. Pat. No. 6,725,931 teaches that a hardenable resin should be applied to all the proppant and should remain tacky after hardening in order to trap any fines passing through the proppant pack. U.S. Pat. No. 7,392,847 teaches an alternative form of surface modification of proppant particles, but again with the objective that the proppant particles in the fracture adhere together. U.S. Pat. No. 7,718,583 discloses a particulate material comprising a polymer capable of hardening under downhole conditions for the purpose of proppant flowback control.

In an alternative embodiment, the conductive and/or electromagnetic fibers may be used in mixtures with particulates for or during well treatment procedures such as fracturing and gravel packing to decrease or eliminate the undesirable transport or flowback of proppant or formation particulates. For example, U.S. Pat. No. 5,782,300 describes, the use of novoloid and novoloid-type polymer material for forming a porous pack in a subterranean formation. Such fibers, with conductive and/or electromagnetic material coated onto the fibers, embedded in the fibers or in the lumen of hollow fibers, could be used for such purpose.

In yet another embodiment, the conductive and/or electromagnetic fibers may be used in methods for hydraulic fracturing a subterranean formation that ensure improvement of the hydraulic fracture conductivity by forming strong proppant clusters uniformly placed in the fracture throughout its length. For example, U.S. Pat. No. 8,061,424, discloses a method comprising: a first stage which comprises injecting into a borehole a fracturing fluid containing thickeners to create a fracture in the formation; and a second stage which comprises introducing a proppant into the injected fracturing fluid to supply the proppant into a created fracture, to form proppant clusters within the fracture thereby preventing fracture closure and forming channels for flowing formation fluids between the clusters, wherein the second stage or its sub-stages involve additional introduction of either a reinforcing or consolidation material or both, thus increasing the strength of the proppant clusters formed into the fracture fluid. The electromagnetic and/or conductive fibers may be part of or in addition to the proppant and/or reinforcing and/or consolidation materials of such a method.

In another alternative embodiment, the electromagnetic and/or conductive fibers may be added in intimate mixture with particulates for fracturing and gravel packing thereby decreasing or eliminating the flowback of proppant and/or formation fines while stabilizing the sand pack and lowering the demand for high polymer loadings in the placement fluids.

In an alternative embodiment, the fibers may be suspended in slick water (water and friction reducer), gelled oil, or combination thereof.

Although only a few example embodiments have been described in detail above, those skilled in the art will readily appreciate that many modifications are possible in the example embodiments without materially departing from the disclosed subject matter of the application. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What we claim are:

1. A method of performing a hydraulic fracturing treatment in a subterranean formation penetrated by a wellbore, the method comprising:

injecting into the wellbore a fracturing fluid with powerful hydraulic pumps to create enough downhole pressure to fracture the formation; and, injecting a fiber composition comprising electrically conductive non-metal fibers, electromagnetic non-metal fibers, or a combination thereof into the subterranean formation during the hydraulic fracturing treatment, wherein the fibers are sheath core fibers comprising a carbon covered core and a protective sheath.

2. The method according to claim 1, wherein the fiber composition is blended with the fracturing fluid used in the hydraulic fracturing treatment.

3. The method according to claim 1, wherein the non-metal fibers are carbon fibers or fibers made from conductive polymers.

4. The method according to claim 1, wherein the fiber composition is present in the fracturing fluid at concentrations from 0.12 to 18 kg/m3 (1 to 150 lb/Mgal) fracturing fluid.

5. The method according to claim 1, wherein the non-metal fibers are polymeric fibers selected from the group of polymeric fibers at least partially coated with a conductive material; polymeric fibers at least partially coated with an electromagnetic material; at least partially hollow polymeric fibers which are at least partially filled with a conductive material; and at least partially hollow polymeric fibers which are at least partially filled with an electromagnetic material.

6. The method according to claim 1, wherein the fiber composition comprises fibers made from conductive polymers and fibers made from non-conductive polymers.

7. The method according to claim 6, wherein the fibers are conductive polymers selected from the group consisting of doped conjugated polymers.

8. The method according to claim 7, wherein the fibers are selected from the group consisting of polyacetylene, poly (p-phenylene), poly(pyrrole), polythiophene, poly(p-phenylene sulfide) and polyaniline.

9. The method according to claim 1, wherein the non-metal fibers are made from a blend of conductive polymers and non-conductive polymers.

10. The method according to claim 1, further comprising:

measuring resistivity of hydraulic fractures created by injecting a fracturing fluid into the subterranean formation; and wherein the fiber composition optionally further comprises metal fibers comprising one or more metals selected from the group consisting of silver, copper, gold, aluminum, zinc, nickel, brass, bronze, iron, platinum, carbonized steel, lead, stainless steel, and combinations of two or more thereof.

11. The method according to claim 1, further comprising:

making electromagnetic measurements of hydraulic fractures created by injecting a fracturing fluid into the subterranean formation; and wherein the fiber composition optionally further comprises metal fibers comprising one or more metals selected from the group consisting of silver, copper, gold, aluminum, zinc, nickel, brass, bronze, iron, platinum, carbonized steel, lead, stainless steel, and combinations of two or more thereof.

12. The method according to claim 1, further comprising:

making electromagnetic measurements, of hydraulic fractures created by injecting a fracturing fluid into the subterranean formation, by crosswell electromagnetic imaging; and wherein the fiber composition optionally further comprises metal fibers comprising one or more metals selected from the group consisting of silver, copper, gold, aluminum, zinc, nickel, brass, bronze, iron, platinum, carbonized steel, lead, stainless steel, and combinations of two or more thereof.

13. The method according to claim 1, further comprising:

measuring resistivity of hydraulic fractures created by injecting a fracturing fluid into the subterranean formation, by crosswell electromagnetic imaging; and wherein the fiber composition optionally further comprises metal fibers comprising one or more metals selected from the group consisting of silver, copper, gold, aluminum, zinc, nickel, brass, bronze, iron, platinum, carbonized steel, lead, stainless steel, and combinations of two or more thereof.

14. The method according to claim 1, wherein the fiber composition is blended with a particulate material and further wherein the particulate material is a polymer material which increases in hardness under down-hole conditions thereby providing proppant flowback control.

* * * * *